United States Patent [19]

Maehara et al.

[11] Patent Number: 4,465,234

[45] Date of Patent: Aug. 14, 1984

[54] LIQUID ATOMIZER INCLUDING VIBRATOR

[75] Inventors: Naoyoshi Maehara; Takashi Uno, both of Nara, Japan

[73] Assignee: Matsushita Electric Industrial Co., Ltd., Osaka, Japan

[21] Appl. No.: 309,014

[22] Filed: Oct. 5, 1981

[30] Foreign Application Priority Data

Oct. 6, 1980 [JP] Japan ..... 55-140318
Oct. 13, 1980 [JP] Japan ..... 55-143480

[51] Int. Cl.[3] ..... B05B 3/14
[52] U.S. Cl. ..... 239/102; 239/406
[58] Field of Search ..... 239/101, 102, 406

[56] References Cited

U.S. PATENT DOCUMENTS

| | | | |
|---|---|---|---|
| 2,512,743 | 6/1950 | Hansell | 239/102 X |
| 2,855,244 | 10/1958 | Camp | 239/102 |
| 3,679,132 | 7/1972 | Vehe et al. | 239/102 X |
| 3,848,118 | 11/1974 | Rittberg | 239/101 |
| 3,900,162 | 8/1975 | Titus et al. | 239/102 |
| 4,276,857 | 7/1981 | Martin | 239/102 X |

FOREIGN PATENT DOCUMENTS 55-94665 2/1974 Japan .

OTHER PUBLICATIONS

Transactions of the ASAE, vol. 17, No. 1, Jan./Feb. 1974, pp. 183–187, Michigan USA, L. F. Bouse et al., "Cyclic Disturbance of Jets to Control Spray Drop Size.

*Primary Examiner*—Andres Kashnikow
*Assistant Examiner*—Mary F. McCarthy
*Attorney, Agent, or Firm*—Lowe, King, Price & Becker

[57] ABSTRACT

An apparatus for atomizing a large quantity of liquid such as water, liquid fuels, lotions or the like, comprises an atomizer including a body having a pressurization cavity for containing a liquid. A nozzle base, mounted on the body, has a plurality of orifices communicating with the pressurization cavity. An electric vibrator, mounted on the body, responds to an alternating voltage derived from an electric circuit. The vibrator is vibrated back and forth, to expel successively a large quantity of liquid droplets of small and uniform diameter out of the orifices.

16 Claims, 13 Drawing Figures

LIQUID ATOMIZER INCLUDING VIBRATOR

BACKGROUND OF THE INVENTION

1. Field of the Invention

The present invention relates to an apparatus for atomizing large quantities of liquid such as liquid fuels, water, lotions or the like.

2. Prior Art

A variety of liquid atomizers have heretofore been proposed and practiced in the art. One such known atomizer utilizes a pump for ejecting a liquid under pressure through a nozzle. According to another conventional atomizing apparatus, liquid droplets are allowed to fall onto a rotating body and caused upon hitting the latter to be atomized under centrifugal forces. These prior systems, however, require a high-pressure pump or a high-speed motor, are large in size and costly to construct, and cannot achieve a satisfactory degree of liquid atomization for certain applications. There are also known ultrasonic atomizers which incorporate an ultrasonic vibrator for breaking up the liquid into small droplets. One form of such ultrasonic atomizers which incorporate an ultrasonic vibrator for breaking up the liquid into small droplets. One form of such ultrasonic atomizer includes a horn vibrator for amplifying the vibrations from an ultrasonic vibrator up to a level large enough to atomize the liquid supplied to a distal end of the horn. This ultrasonic vibrator is disadvantageous in that the vibration amplifying horn is complex in structure, difficult to machine, expensive to manufacture, and fails to produce liquid droplets of satisfactory diameter. The vibrator necessitates a liquid supplying device such as a pump, and hence is large-sized and cannot be built inexpensively. Another known ultrasonic atomizer comprises an ultrasonic vibrator mounted on the bottom of a liquid container for directly transmitting ultrasonic energy into the liquid to atomize the latter with the ultrasonic energy that reaches the surface of the liquid in the container. Although the ultrasonic atomizing apparatus for direct ultrasonic liquid atomization needs no liquid supplying unit such as a pump and atomizes the liquid into desired droplets, the atomizer consumes a great amount of electric energy for atomization and produces ultrasonic vibrations at quite a high frequency which ranges from 1 MHz to 2 MHz. Such highfrequency ultrasonic vibrations have an increased level of undesirable radiation which has a great potential for causing disturbance of radio waves received by television and radio receivers. Therefore, the atomizer is required to be equipped with a vibrator driving circuit and a noise prevention means, and hence is costly to construct.

U.S. Pat. No. 3,683,212, to Zoltan, patented Aug. 2, 1972, discloses a system for ejecting a train of small liquid droplets through a single orifice in response to pressure increases due to changes in volume of a piezoelectric element to which electric command pulses are applied. The disclosed system can produce a succession of droplets of uniform diameter and is suitable for use in ink jet printers and recorders. The prior droplet ejecting system, however, cannot be used in a liquid fuel burner or a humidifier which atomizes a large amount of liquid, at a rate of 1 to 20 cc/min., into small uniform droplets. More specifically, when the voltage of supplied pulses is increased in order to produce droplets in large quantities, the liquid is broken up into droplets of large diameter. Application of pulses at a higher frequency makes it impossible to eject liquid droplets out of the orifice. The Zoltan system therefore fails to form droplets of small and uniform diameter in large quantities.

In U.S. Pat. No. 3,747,120 to Stemme, patented Jul. 17, 1973, an apparatus for ejecting a succession of small droplets is effective for use in recording devices such as an ink jet printer, but is unable to generate large quantities of atomized liquid as small uniform droplets. The disclosed droplet generator comprises a plurality of superimposed plates having small-diameter channels held in coaxial alignment, a structure which is quite difficult to assemble.

Experiments conducted by the present inventors indicated that the system as shown in U.S. Pat. No. 3,747,120 produced liquid droplets at a rate of about 0.5 cc/min. even when the droplets are of an excessively large diameter, and ejected liquid droplets of smaller diameter at an approximate rate of about 0.1 to 0.2 cc/min. Thus, Zoltan's system has experimentally been proven to fail to eject a large quantity of liquid droplets of small and uniform diameter.

SUMMARY OF THE INVENTION

In accordance with the present invention, an atomizer includes a nozzle base having a plurality of orifices communicating with a pressurization cavity in a body of the atomizer to which the body is attached. A liquid to be atomized is filled in the cavity substantially at an atmospheric pressure or a pressure slightly less than atmospheric for better liquid atomization. An electric vibrator comprising a vibration plate and a plate of piezoelectric ceramics bonded to the vibration plate is mounted on the body. The electric vibrator is responsive to an alternating voltage applied thereacross for vibratory movement to expel the liquid as fine uniform droplets out of the cavity through the orifices. An electric control circuit, connected to the electric vibrator, applies the alternating voltage thereacross to displace the vibrator back and forth periodically for successive ejection of the liquid droplets. The electric control circuit includes a means for changing the alternating voltage in order to produce liquid droplets controllably in a variety of quantities.

It is an object of the present invention to provide an atomizing apparatus for producing a large quantity of fine and uniform droplets of liquid.

Another object of the present invention is to provide a liquid atomizing apparatus which is relatively simple in structure, reliable in operation, small in size, and inexpensive to manufacture.

Still another object of the present invention is to provide an atomizing apparatus including means for producing atomized liquid in a variety of controlled quantities.

Still another object of the present invention is to provide an atomizing apparatus which consumes a relatively small amount of energy for liquid atomization.

The above and other objects, features and advantages of the present invention will become more apparent from the following description when taken in conjunction with the accompanying drawings in which some preferred embodiments of the present invention are shown by way of illustrative example.

DETAILED DESCRIPTION OF THE PREFERRED EMBODIMENTS

Figure 1:
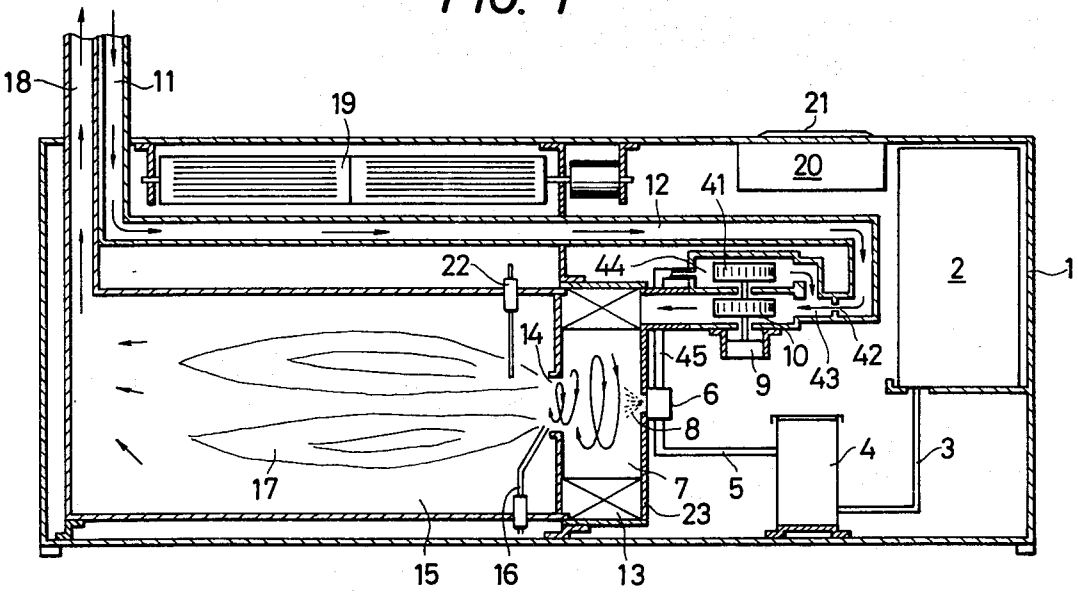
FIG. 1 is a longitudinal cross-sectional view of a liquid-fuel burner which incorporates an electric liquid atomizing apparatus according to the present invention.

As illustrated in FIG. 1, a liquid-fuel burner comprises a casing 1, a fuel tank 2 housed in the casing 1, a fuel leveller 4 mounted in the casing 1 and connected to the fuel tank 2 by a pipe 3 supplied with a liquid fuel from the tank 2, and an atomizer 6 disposed in the casing 1 and connected to the fuel leveller 4 by a pipe 5 through which the liquid fuel can be delivered from the fuel leveller 4 to the atomizer 6. The atomizer 6 atomizes the supplied liquid fuel and ejects fuel droplets 8 thus atomized into a mixing chamber located adjacent to the atomizer 6.

Air is introduced by an air delivering system comprising an air charging fan 10, driven by a motor 9; air is supplied to fan 10 through an air delivery pipe 11. The fan 10 supplies draft to an air rotator or swirling device 13 for supplying a swirling stream of air into the mixing chamber 7, in which air is mixed with the fuel droplets 8. The swirling fuel-air mixture is discharged through a discharge port 14 into a combustion chamber 15. The mixture is then ignited by an ignition means 16, producing flames 17. An exhaust gas is discharged from the combustion chamber 15 through an exhaust pipe 18 that extends out of the casing 1. The heat energy generated by the combustion in the combustion chamber 15 is transferred to air forced by a fan 19 to move around the combustion chamber 15, the heated air being dischargable into a room in which the liquid-fuel burner is installed. Thus, the liquid-fuel burner serves as a heater for discharging hot air.

The liquid-fuel burner is equipped with a controller 20 for controlling operation of the burner, i.e., operation of the fans 10, 19, the atomizer 6, the ignition means 16 and other components in response to command signals from a control panel 21, and signals from a frame condition detector 22 and a room temperature detector (not shown).

Figure 2:
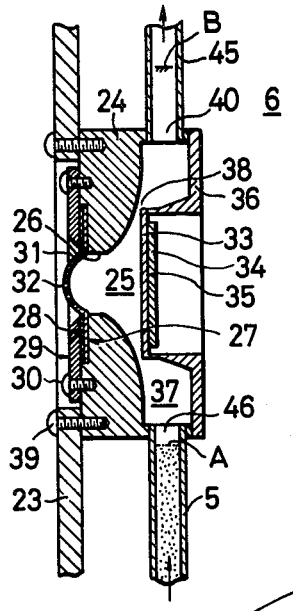
FIG. 2 is an enlarged cross-sectional view of an atomizer of the present invention.
Figure 3:
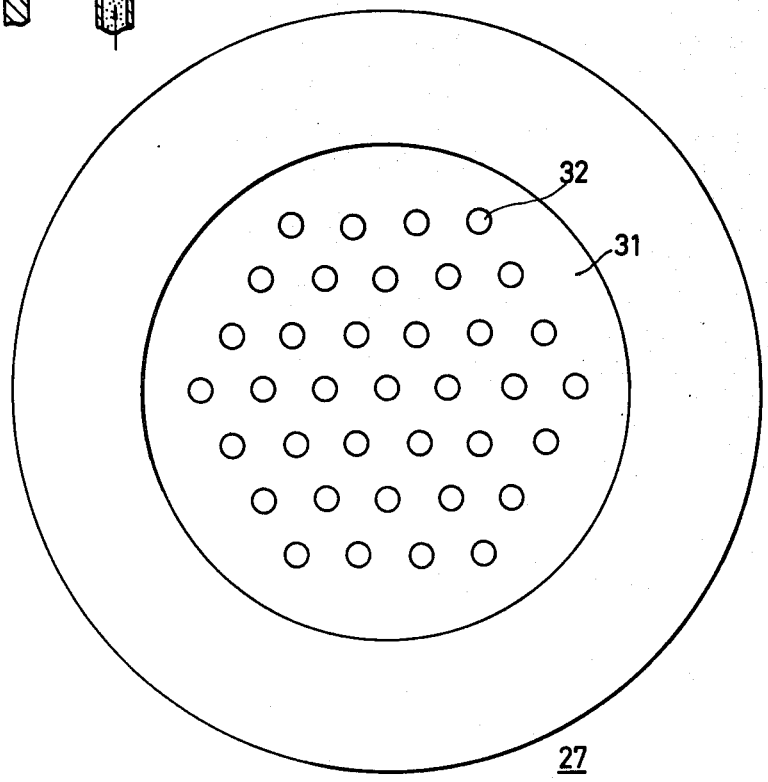
FIG. 3 is an enlarged plan view of a nozzle base in the atomizer shown in FIG. 2.
Figure 4:
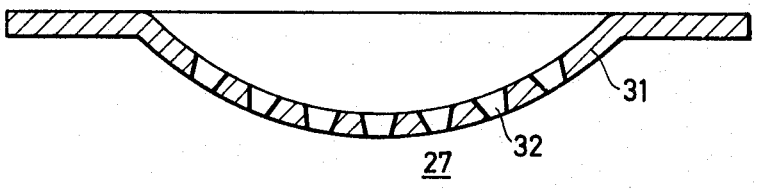
FIG. 4 is an enlarged diametrical cross-sectional view of the nozzle base illustrated in FIG. 3.
Figure 5:
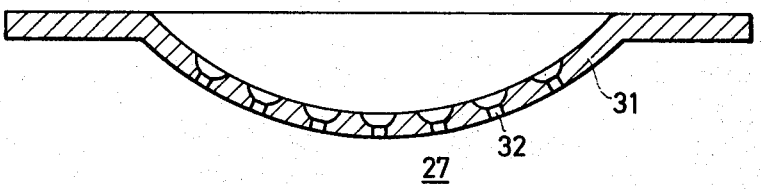
FIG. 5 is an enlarged diametrical cross-sectional view of a modified nozzle base.

As illustrated in FIG. 2, the atomizer 6 comprises a body 24 having a first pressurization cavity 25 which is in the shape of an exponential horn. The pressurization cavity 25 has a cylindrical front end portion 26 having an inside diameter of 3 mm on which there is mounted a circular nozzle base 27 peripherally sealed by a gasket 28 and held in position by a holder plate 29 that is fastened to the body 24 by screws 30. The nozzle base 27 includes a central curved or partly spherical portion or nozzle 31 having a plurality (thirty seven as illustrated in FIG. 3) of orifices 32 that are arranged in rows and spaced at equal intervals or equidistantly from adjacent ones. Each of the orifices 32 is horn-shaped or conically tapered as shown in FIG. 4 such that an outlet end thereof on the convex side is smaller in cross-sectional area than an inlet end thereof on the concave side. The outlet end of each orifice 32 has a diameter of 80 μm and the inlet end thereof has a diameter of about 90 to 100 μm. A modified nozzle base 27, illustrated in FIG. 5, comprises a curved portion 31 having therein a plurality of orifices 32 each in the form of a combined bowl and cylinder.

The nozzle base 27 is made from a plate of stainless steel having a thickness of 50 μm by first defining the orifices 32 in the plate through a one-sided etching process, and then embossing the central curved portion 31. With the one-sided etching process, the horn-shaped orifices 32 can be formed with utmost ease and relatively inexpensively.

In FIG. 2, a circular electric vibrator 35 is mounted in the cavity 25 at a rear end portion thereof, the electric vibrator 35 comprising a vibration plate 33 of metal and a plate 34 of piezoelectric ceramics bonded to the vibration plate 33, the vibration plate 33 being integral with a support 36 attached to the atomizer body 24. The body 24 and the support 36 jointly define a second cavity 37 therebetween which is held in fluid communication with the first cavity 25 through a passage 38 extending circumferentially all around the electric vibrator 35.

The pipe 5 is connected to a lower end of the body 24 in communication with the second cavity 37 through a fuel filling channel 46 in the body 24. The fuel leveller 4 controls the level of the liquid fuel to be maintained at the position A (FIG. 2) in the pipe 5 just below the atomizer 6. The atomizer body 24 is secured by screws 39 to a wall 23 of the mixing chamber 7 with the orifices 32 opening into the mixing chamber 7. The body 24 is connected at an upper end thereof to an air suction pipe 45 coupled to a connector pipe 43 (FIG. 1) disposed upstream of the fan 10 through an air suction fan 41 housed in an air suction chamber 44 and coaxially connected to the fan 10 for corotation. The air delivery pipe 12 is coupled through an orifice or restrictor 42 to the connector pipe 43. The air suction pipe 45 is held in fluid communication with the second chamber 37 through an air exhausting channel 40 in the body 24. When liquid fuel is supplied through the fuel filling channel 46 into cavities 25 and 37, air is forced out of these cavities 25 and 37 through the air exhausting channel 40 into the air suction pipe 45, while preventing the liquid fuel as supplied from leaking out through the orifices 32.

Operation of the liquid atomizing apparatus thus constructed will now be described with reference to FIGS. 1, 2, 6, 7 and 8.

In FIG. 1, when the motor 9 is energized under the control of the controller 20, the air charging fan 10 and the air suction fan 41 rotate together, whereupon there is developed a negative pressure of about 2 to 3 mm Ag in the connector pipe 43 due to the orifice 42. The air suction fan 41 also developes a negative pressure of about 5 to 10 mm Ag in the air suction chamber 44 and hence in the air suction pipe 45. Since the orifices 32 are extremely small in diameter, the amount of air introduced therethrough into the first cavity 25 is also extremely small. The fuel level is now raised from the position A to the position B as shown in FIG. 2, whereupon cavities 25 and 37 are filled up with the liquid fuel supplied. Thus, the air suction fan 41, the air suction chamber 44 and the air suction pipe 45 jointly serve as a fuel filling system for cavity 25.

The fuel filling system plays quite an important role in that it develops a total negative pressure that is imposed on the liquid surface. Thereby cavity 25 is filled with fuel substantially at an atmospheric pressure or a lower pressure. If the fuel in the cavity 25 were under a pressure higher than the atmospheric pressure, the fuel would tend to leak through the orifices 32 and no desired fuel droplets could be ejected through the orifices 32 in response to vibration of the electric vibrator 35. Therefore, to atomize the fuel into proper droplets, cavity 25 is filled with fuel substantially at an atmospheric pressure or a lower pressure.

Figure 7:
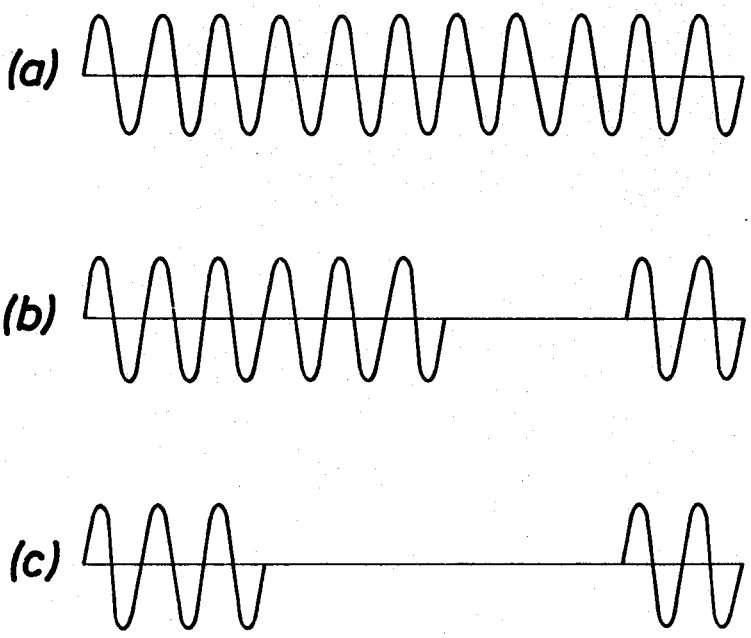
FIG. 7 is a diagram illustrative of waveforms of three alternating-voltage signals for driving the electric vibrator at maximum, medium, and minimum power requirements.
Figure 6:
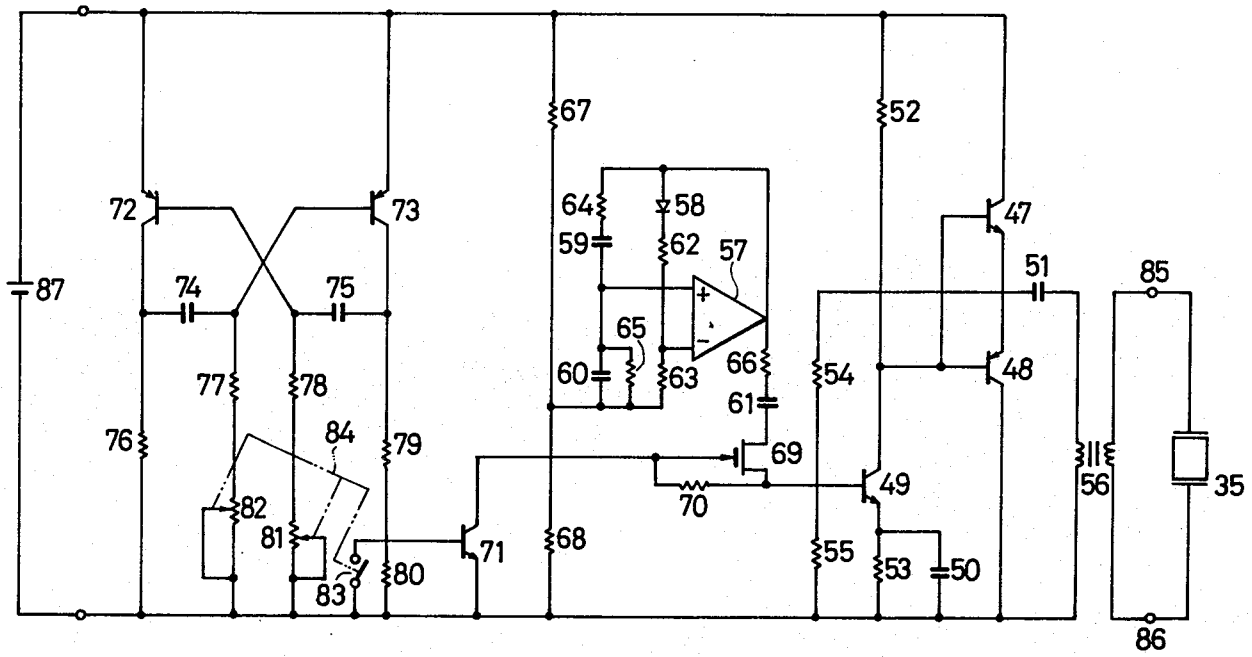
FIG. 6 is a circuit diagram of a voltage generator for applying an alternating voltage to an electric vibrator in the atomizer.

The controller 20 includes a means for generating alternating voltages to be applied to the electric vibrator 35. A diagram of the circuit for generating the alternating voltages is illustrated in FIG. 6, and waveforms of generated alternating voltages are shown in FIG. 7 at (a), (b), and (c). The alternating-voltage generating means, FIG. 6 comprises an amplifying output circuit including transistors 47, 48 and 49, capacitors 50, 51, resistors 52, 53, 54 and 55, and an output transformer 56, a Wien bridge oscillator circuit including an operational amplifier 57, a diode 58, capacitors 59, 60, and 61, and resistors 62, 63, 64, 65, 66, 67, and 68, a switching circuit including an N-CH FET (N-channel field effect transistor) 69, a resistor 70, and a transistor 71, and a duty-cycle controlling circuit including transistors 72, 73, capacitors 74, 75, resistors 76, 77, 78, 79 and 80, variable resistors 81, 82, and a switch 83. The variable resistors 81, 82 and the switch 83 are ganged together by a control 84 such that when the control 84 is actuated in one direction, the resistance of the variable resistor 81 is reduced, the resistance of the variable resistor 82 is increased, and the switch 83 is closed when the control 84 reaches the end of the stroke in said one direction. The N-CH FET 69, therefore, has a duty cycle D which is rendered continuously variable by the control 84 at a constant frequency within the following range:

Minimum value $\leqq D \leqq 1$

In response to the position of controller 84 the oscillator circuit can supply the amplifying output circuit with various sine-wave voltage signals, as shown in FIG. 7 by waveforms (a), (b) and (c). An output alternating voltage applied through output terminals 85, 86 across the electric vibrator 35 is variable accordingly and can selectively bus one of waveforms illustrated in FIG. 7 (a), (b) and (c). The average power fed to the electric vibrator 35 can easily and reliably be controlled by the control 84. Thus, the variable resistors 81, 82 and the switch 83 jointly constitute a means for adjusting the quantity of fuel droplets ejected by controlling the average power supplied to the electric vibrator 35. The controller 20 also includes a dc power supply 87 for supplying a dc power to the circuits therein.

Application of the alternating voltage across the electric vibrator 35 causes the latter to vibrate, enabling the atomizer 6 to atomize the liquid fuel into fine droplets.

Figure 8:
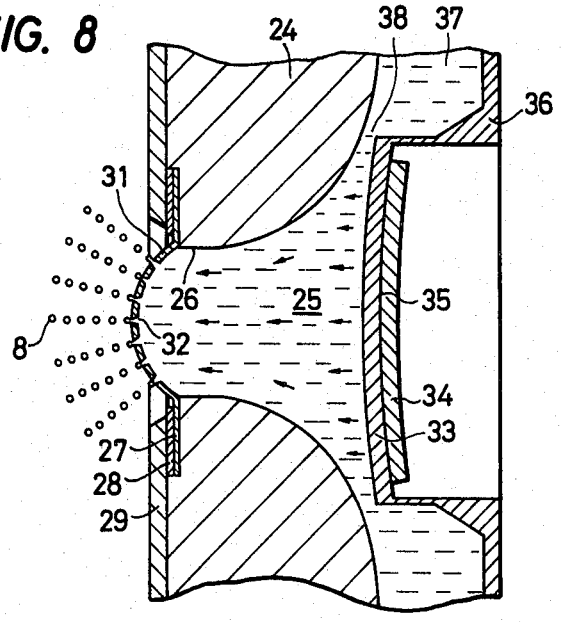
FIG. 8 is an enlarged fragmentary cross-sectional view of the atomizer as it is in a droplet-expelling mode of operation with the electric vibrator bent in one direction.

When a positive half cycle of the sine-wave voltage shown in FIG. 7 by waveforms (a), (b), or (c) is applied to the electric vibrator 35, the latter bends toward the first cavity 25 as shown in FIG. 8 causing a pressure increase in the first cavity 25. The pressure buildup is progressively greater toward the nozzle base 27 due to the horn-shaped cavity 25. The liquid fuel is then expelled out of the first cavity 25 through the orifices 32 as small and uniform droplets 8 having a diameter on the order of 50 μm. While in the embodiment illustrated in FIG. 2 the first cavity 25 is horn-shaped, it may be other shapes since ejection of fuel droplets is primarily dependent in principle on changes in volume of the first cavity which are caused by displacement of the electric vibrator 35. Furthermore, the electric vibrator 35 may be shaped and positioned differently from the foregoing embodiment provided it can cause volume changes in the first cavity to propel fuel droplets through the orifices 32.

Figure 9:
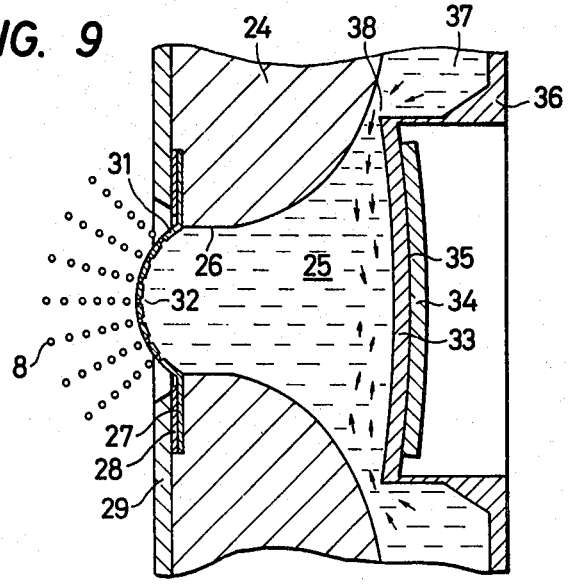
FIG. 9 is a view similar to FIG. 7, showing the atomizer as it is in a liquid-supplying mode of operation with the electric vibrator displaced in the opposite direction.

Application of the alternating voltage during the negative half cycle causes the electric vibrator 35 to bend away from the nozzle base 27 as illustrated in FIG. 9. Thereby a negative pressure is developed in the first cavity 25 adjacent the electric vibrator 35, replacing the expelled liquid fuel with an additional amount of liquid fuel that is supplied in the directions indicated by arrows (FIG. 9) through the passage 38. Since the cavity 25 is filled with fuel at a static pressure which is equal substantially to atomspheric pressure or a pressure slightly less than atmospheric, the droplets as ejected through the orifices 35 do not join together into droplets of excessive diameters, and the fuel does not spill through the orifices 32 onto the outer surface of the nozzle base 27 due to the surface tension of the liquid fuel at the orifices 32. Accordingly, proper droplet ejection according to the present invention requires the liquid pressure developed in the cavity 25 to be smaller than the surface tension of the liquid fuel at the orifices 32. The surface tension of the liquid fuel also prevents ambient air from flowing into the cavity 25 through the orifices. With the passage 38 extending circumferentially around the circular electric vibrator 35, the liquid fuel is smoothly and uniformly supplied from the second cavity 37 into the first cavity 25. Static pressure on the liquid fuel in the first cavity 25 becomes negative enough to prevent introduction of air through the orifices 32 into the first cavity 25. The second cavity 37 reduces resistance to the flow of liquid into the first cavity 25, an arrangement which also assists in smooth and balanced supply of the fuel into the first cavity 25 and preventing air from flowing back into the first cavity 25 under the negative pressure built up therein.

The electric vibrator 35 is bent or displaced back and forth repeatedly in response to application thereacross of one of alternating voltages having the waveforms (a), (b), and (c) of FIG. 7. Thereby, liquid droplets 8 of a very small and uniform diameter are ejected through apertures 32 in a controlled quantity which ranges from 1 cc/min. to 20 cc/min.

There this a dangerous tendency for the nozzle base 27 to vibrate under the influence of pressures produced by the electric vibrator 35, causing air to flow into the first cavity 25 through the orifices 32. The presence of such air in the first cavity 25 has a tendency to reduce the tendency of pressure to increase in response to the electric vibrator 35; the pressure has a tendency to be reduced to an extent which is sufficient to prevent smooth and reliable ejection of fuel droplets 8 through the orifices 32.

Such a dangerous or difficult tendency however is completely eliminated by the curved nozzle portion 31 of the nozzle base 27, which gives the latter an increased degree of rigidity making the nozzle base 27 resistant to vibrations. The curved or partly spherical nozzle portion 31 can disperse fuel droplets 8 in different directions in a wide conical space in which the droplets 8 are prevented from re-uniting into larger droplets; hence droplets 8 has a uniform diameter. The small uniform diameter fuel droplets 8 can easily be mixed with air which is introduced in a swirling motion to help carry away the droplets 8 into the combustion chamber 15 or to produce the fuel-air mixture.

With the horn-shaped or conical orifices 32, the liquid fuel is subjected to an increased pressure in the orifices 32 while being expelled therethrough under the pressure buildup developed by the electric vibrator 35. The liquid fuel is accelerated at the outlets of the orifices 32 to a speed great enough to overcome the surface tension of the liquid fuel at the orifice outlets. The horn-shaped orifices 32 also assist in separating the liquid fuel in the first cavity 25 from the ejected droplets 8 when the electric vibrator 35 is deflected away from the nozzle base 27, as shown in FIG. 9.

Figure 10:
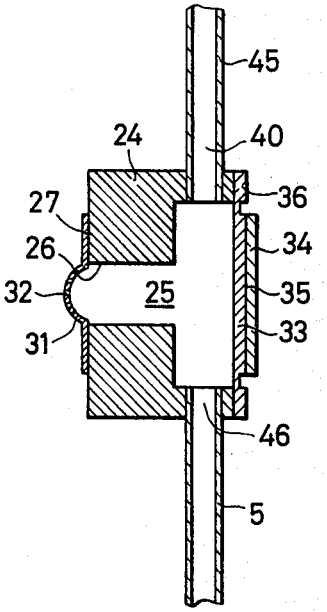
FIG. 10 is a cross-sectional view of an atomizer according to another embodiment.

FIG. 10 is a cross sectional view of an atomizer according to another embodiment of the present invention. The atomizer comprises a nozzle base 27 bonded to a body 24, and an electric vibrator 35 located remotely from the nozzle base 27 and outside of a cavity 25 in the body 24.

Figure 11:
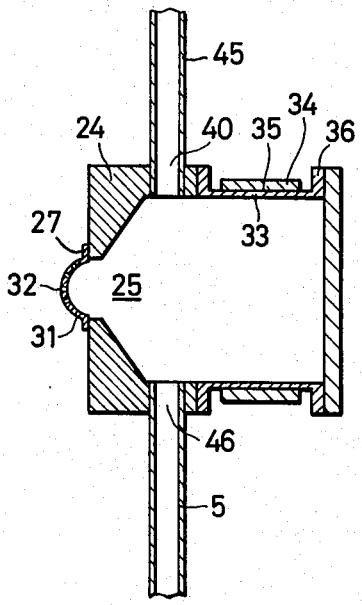
FIG. 11 is a cross-sectional view of an atomizer according to still another embodiment.

According to another embodiment illustrated in FIG. 11, an electric vibrator 35 is formed as a hollow cylinder disposed around and abutting against exterior wall 33 of cavity 25.

Figure 12:
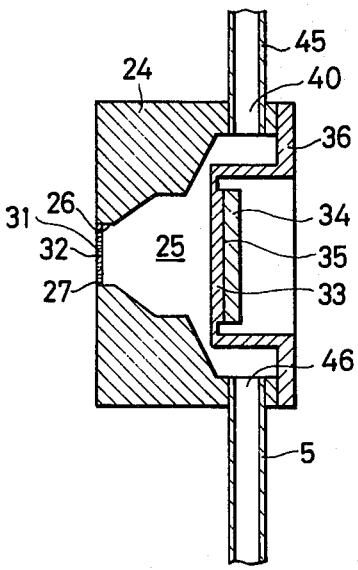
FIG. 12 is a cross-sectional view of an atomizer in accordance with still another embodiment.

An atomizer in accordance with still another embodiment shown in FIG. 12 includes a flat nozzle base 27 integral with atomizer body 24, including cavity 25 having a horn like shape tapering inwardly from vibrator 35 toward base 27.

Figure 13:
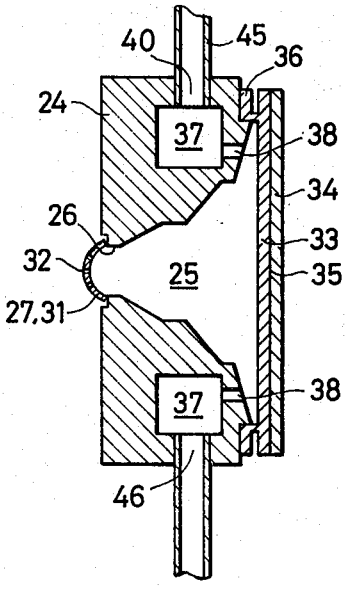
FIG. 13 is a cross-sectional view of an atomizer in accordance with still another embodiment.

As illustrated in FIG. 13, an atomizer according to still another embodiment has an annular or doughnut-shaped second cavity 37 defined in a body 24 in surrounding relation to a first cavity 27. The first and second cavities 25, 37 are in fluid communication with each other by four passages 38 (two shown) positioned near the outer periphery of an electric vibrator 35 and angularly spaced 90 degrees from adjacent passages 38. The passages 38 are spaced equidistantly from the axial center of the electric vibrator 35 and hence the first cavity 25 for the smooth and equal distribution of liquid fuel supplied from the second cavity 37 into the first cavity 25.

Advantages accruing from the arrangement of the present invention are as follows: No separate liquid supply unit or pump is required as the atomizer is of the self-priming type for automatically replacing discharged droplets in the first cavity 25 through the liquid filling channel 46. Therefore, the atomizing apparatus is relatively simple in structure, small in size, and inexpensive to construct. The nozzle base 27 has a plurality of orifices 32 for ejecting therethrough fine and uniform liquid droplets in large quantities in response to a pressure increase in the cavity 25 caused by the electric vibrator 35. The air exhausting channel 40 allows air to be discharged out of cavities 25 and 37 when liquid fuel is introduced through the liquid filling channel 46. No liquid fuel flows out through the orifices 32 when the cavity 25 is charged with the liquid fuel. The curved portion 31 serves as a stiffener for the nozzle base 27 for protection against vibration of the latter during operation of the atomizer 6. Accordingly, the flow of air into the cavity 25 through the orifices 32 is prevented for stabilized liquid atomization. The electric vibrator 35 consumes a small amount of electric power since it requires only vibratory energy to be applied to the liquid which fills the cavity 25. The atomizing apparatus also has a relatively small power requirement and produces a reduced amount of noise or unnecessary energy radiation. The quantity of liquid droplets expelled can easily be adjusted by controlling the average power with which the electric vibrator 35 is energized. The horn-shaped orifices 32 can easily be formed using the one-sided etching process. The orifices 32 thus shaped are conductive to generating of small and uniform liquid droplets. The second cavity 37 and the symmetrically defined passage 38 permit liquid to be introduced smoothly into the first cavity 25 without developing an excess negative pressure in the latter, a structure which assures stable liquid atomization. The air delivery system and the fuel filling system are coupled with each other for joint operation. This structure serves as a fail-safe device to prevent atomization from being started while the air delivery system is not operating. With the air delivery system and fuel filling system thus combined, the atomizing apparatus is simpler in structure and less costly to manufacture. The fuel filling system is operated under air pressure and hence is relatively simple and inexpensive.

Although various preferred embodiments have been shown and described in detail,it should be understood that many changes and modifications may be made therein without departing from the scope of the appended claims.

What is claimed is:

1. An atomizing apparatus comprising:

(a) a body having a cavity for containing a liquid filled therein;

(b) a nozzle base mounted on said body, the nozzle base having a plurality of orifices in fluid flow relation with the liquid in said cavity;

(c) an electric vibrator mounted on said body, the vibrator being movable for cyclically pressurizing the liquid in said cavity, the vibrator, cavity, nozzle base and plurality of orifices being arranged so that liquid in the cavity flows into the nozzle base through the plurality of orifices in response to the vibrator cyclically pressurizing the liquid in the cavity;

(d) means for filling and maintaining the liquid in said cavity at a pressure no greater than substantially atmospheric pressure;

(e) electric means for supplying an alternating voltage to said electric vibrator to displace the vibrator back and forth periodically, whereby said liquid in said cavity can be pressurized to be successively expelled as atomized droplets out of said orifices; and (f) means operatively coupled with said filling means for delivering air to carry therewith said atomized droplets expelled out of said orifices.

2. An atomizing apparatus according to claim 1, said filling means being responsive for its operation to an air pressure developed by said air delivering means.

3. An atomizing apparatus comprising:

(a) a body having a cavity for containing a liquid filled therein, a liquid filling channel for supplying the liquid to said cavity, and an air exhausting channel for discharging air from said cavity;

(b) a nozzle base mounted on said cavity, the nozzle base having a plurality of orifices in fluid flow relation with the liquid in said cavity;

(c) an electric vibrator mounted on said body, the vibrator being movable for cyclically pressurizing the liquid in said cavity, the vibrator, cavity, nozzle base and plurality of orifices being arranged so that liquid in the cavity flows into the nozzle base through the plurality of orifices in response to the vibrator cyclically pressurizing the liquid in the cavity;

(d) a liquid filling system for maintaining the liquid in said cavity at a pressure no greater than substantially atmospheric pressure; and (e) electric means for supplying an alternating voltage to said electric vibrator to displace the vibrator back and forth periodically, whereby said liquid in said cavity can be successively expelled as atomized droplets out of said cavity through said orifices in response to the cyclic pressure by said electric vibrator.

4. An atomizing apparatus according to claim 3, including means for filling the liquid in said cavity to a pressure substantially no greater than atmospheric pressure.

5. An atomizing apparatus according to claim 3, wherein said liquid filling system includes a liquid supply system having a means for maintaining a liquid level at a position lower than said cavity under atmospheric pressure, said liquid filling channel being connected to said liquid supply system for maintaining the liquid in said cavity substantially at an atmospheric pressure or a pressure therebelow.

6. An atomizing apparatus according to claim 3, wherein said liquid filling system includes a suction fan connected to said air exhausting channel for sucking air from said cavity.

7. An atomizing apparatus according to claim 6, further including a mixing chamber downstream of the nozzle base responsive to atomized liquid flowing through the orifices, the mixing chamber also being responsive to air that is mixed with the atomized liquid flowing through the orifices.

8. An atomizing apparatus according to claim 7, further including a second fan for supplying the air that is mixed with the atomized liquid flowing to the mixing chamber.

9. An atomizing apparatus according to claim 8, wherein said suction and second fans are respectively located in second and third chambers, the second chamber having an inlet connected to said air exhausting channel and an outlet connected to an inlet of said third chamber, the third chamber inlet being responsive to air from an outside source, the second chamber being an outlet connected to an inlet of the mixing chamber.

10. An atomizing apparatus according to claim 9, wherein said suction and second fans have coaxial drive shafts connected to a common motor shaft.

11. A structure for atomizing a liquid comprising means forming a chamber, a first conduit for supplying liquid to a first side of the chamber, a piezoelectric plate abutting against a face of the chamber for vibrating the face, a nozzle base defining a wall of the chamber opposite the vibrating face, a plurality of orifices in the nozzle base, a second conduit through which gas is sucked from a second side of the chamber while the face is vibrating, the nozzle base and vibrating face being centrally located in the chamber relative to the first and second sides, the first and second sides being opposite to each other relative to the nozzle base and vibrating face, a connection point of the first conduit to the first side being vertically disposed below the chamber, and means for maintaining the liquid in the first conduit at a predetermined level below the connection point, the first conduit and chamber being arranged so that liquid supplied by the first conduit to the chamber is atomized to flow through the orifices in response to the vibrating face being vibrated by the piezoelectric plate.

12. The structure of claim 11 further including a suction fan connected to the second conduit for sucking gas from the chamber through the second conduit while the vibrating face is being vibrated by the piezoelectric plate.

13. The structure of claim 12 further including a mixing chamber downstream of the nozzle base to be responsive to atomized liquid flowing through the orifices, the mixing chamber also being responsive to gas that is mixed with the atomized liquid flowing through the orifices.

14. The structure of claim 13 further including a second fan for supplying the gas that is mixed with the atomized liquid flowing to the mixing chamber.

15. The structure of claim 14 wherein the suction and second fans are respectively located in second and third chambers, the third chamber having an inlet connected to the second conduit and an outlet connected to an inlet of the second chamber, the second chamber inlet being responsive to gas from an outside source, the second chamber being an outlet connected to an inlet of the mixing chamber.

16. The structure of claim 15 wherein the suction and second fans have coaxial drive shafts connected to a common motor shaft.

* * * * *